US005871340A

United States Patent [19]

Hatton

[11] Patent Number: 5,871,340

[45] Date of Patent: Feb. 16, 1999

[54] APPARATUS FOR COOLING HIGH-PRESSURE BOOST HIGH GAS-FRACTION TWIN-SCREW PUMPS

[76] Inventor: Gregory John Hatton, 3207 Rambling Creek Dr., Kingwood, Tex. 77345

[21] Appl. No.: 671,697

[22] Filed: Jun. 28, 1996

Related U.S. Application Data

[62] Division of Ser. No. 462,910, Jun. 5, 1995, abandoned.

[51] Int. Cl.[6] ..... F04B 17/00; F04B 35/02

[52] U.S. Cl. ..... 417/377; 417/406; 418/9; 418/15

[58] Field of Search ..... 417/377, 406, 417/408; 418/9, 15

[56] References Cited

U.S. PATENT DOCUMENTS

| | | | |
|---|---|---|---|
| 2,100,560 | 11/1937 | Kennedy | 417/406 |
| 3,693,601 | 9/1972 | Sauder | 418/9 |
| 5,192,199 | 3/1993 | Olofsson | 417/406 |

FOREIGN PATENT DOCUMENTS

| | | | |
|---|---|---|---|
| 2245493 | 10/1990 | Japan | 418/9 |
| 94027049 | 11/1994 | WIPO | 418/15 |

*Primary Examiner*—John J. Vrablik
*Attorney, Agent, or Firm*—Philip T. Golden; Winstead, Sechrest & Minick P.C.

[57] ABSTRACT

Apparatuses are described for cooling the rotors of, improving the sealing of, and improving the power efficiency of twin-screw pumps. Such methods include (1) injecting liquid onto the rotor and into the rotor chambers at the point of greatest temperature accumulation, (2) implanting a heat transfer device within the rotor enclosure that can transfer heat outside of the rotor enclosure, and (3) injecting liquid into rotor chambers via energy recovery devices which reduce the total power consumption of the system.

1 Claim, 11 Drawing Sheets

APPARATUS FOR COOLING HIGH-PRESSURE BOOST HIGH GAS-FRACTION TWIN-SCREW PUMPS

This application is a division of application Ser. No. 08/462,910 filed Jun. 5, 1995 abandoned.

FIELD OF THE INVENTION

This invention generally relates to an apparatus for pumping multiphase fluids as in oil field production, particularly to a twin-screw pump for providing a large pressure boost to high gas-fraction inlet streams. Specifically, the invention relates to a twin-screw pump having means for cooling, improving the sealing of, and increasing the power efficiency of the pump without significant loss of volumetric efficiency. More specifically, the invention relates to an apparatus for (1) removing heat from the rotors by injecting liquids onto the pump rotors or into the rotor chambers, or dissipating heat from the rotors by using a heat transfer device, (2) providing liquids to improve sealing when pumping high gas-fraction streams, and (3) compressing the multiphase fluids more efficiently, resulting in improved power efficiency.

BACKGROUND OF THE INVENTION

Drilling for oil and gas is an expensive, high-risk business, even when the drilling is carried out in a proven field. Petroleum development and production must be sufficiently profitable over the long term to withstand a variety of economic uncertainties. Multiphase pumping is increasingly being used to aid in the production of wellhead fluids. Both surface and subsea installations of these pumps are increasing well production. Multiphase pumps are particularly helpful in producing remote fields and many companies are considering their use for producing remote pockets of oil and for producing deep water reservoirs from shallower water facilities. These pumps allow producers to transport wellhead fluids (oil, water, and gas) to distant processing facilities (instead of building new processing facilities near the wellheads). These pumps also allow lower final reservoir pressures before abandoning production and consequently a greater total recovery from the reservoir.

For deep water reservoirs, producers are very interested in using multiphase pumps to transport wellhead fluids from deep waters to shallow water processing facilities. While there are a number of technical difficulties in this type of production, the cost savings are very large. To build processing facilities over reservoirs in waters 6,000 to 10,000 feet deep cost tens of billions of dollars, as compared to a cost of hundreds of millions of dollars to build such facilities in moderate water depths of 400 to 600 feet. Consequently, producers would like to transport wellhead fluids from the sea-floor in deep waters through pipelines to processing facilities in moderate water depths.

Currently, transport distances of 30 to 60 miles are being considered. In many locations around the world, a 30 to 60 mile reach from the edge of the continental shelf into deeper waters significantly increases the number of oil reservoirs which could be produced. In the Gulf of Mexico, for example, such a reach typically goes to water depths of 6,000 feet and deeper. In the near future, greater reaches up to 100 miles are envisioned. Multiphase pumps are a design being considered for supplying the pressure boost required for this long-distance transport of wellhead fluids. They are typically connected at one end to a Christmas tree manifold, whose casing head is attached to the top of wells from which fluids flow as a result of indigenous reservoir energy, and at the other end to a pipeline which transports the fluids to the remote processing site.

Wellhead fluids can exhibit a wide range of chemical and physical properties. These wellhead fluid properties can differ from zone to zone within a given field and can change with time over the course of a well's life. Furthermore, well bore flow exhibits a well-known array of flow regimes including slug flow, bubble flow, stratified flow, and annular mist, depending on flow velocity, geometry, and the aforementioned fluid properties. Consequently, the ideal multiphase pump should allow for a broad range of input and output parameters without unduly compromising pumping efficiency and service life.

Pumping gas-entrained liquids of varying gas content presents a difficult design problem. Some pumps that have been used include twin-screw pumps, helico-axial pumps, counter-rotating axial-flow pumps, piston pumps, and diaphragm pumps. Twin-screw pumps are one of the favored types of pump for handling the wide range of liquid/gas ratios found in wellhead fluids. Nevertheless, this type of pump has its detractors. For example, one well-known problem for twin-screw pumps is pump seizing.

A twin-screw pump has two rotors that rotate in a close-fitting casing (rotor enclosure). For a given inlet volumetric rate, gas fraction increases result in mass rate reductions, decreases in the thermal transport capacity of the pumped fluids, and temperature elevations in the pump. Consequently, at high pressure boosts, for a given set of operating conditions, a critical gas fraction exists. Pumping at gas fractions greater than the critical gas fraction will result in excessive heating of the pump rotors causing an expansion of the rotors such that the rotors will interfere with the pump body (rotor enclosure) causing the pump to seize.

In typical oil field applications, the gas fraction (or percentage of gas content of the wellhead fluid by volume at inlet conditions) is required to be less than some upper limit for a given pump pressure boost. This limit is typically around 95 to 97% gas fraction for pressure boosts of around 900 psi. In order to ensure that wellhead fluids do not exceed this requirement, several approaches have been taken including: (1) buffer tanks have been added upstream of the pump to dampen excessive gas/liquid ratio variations, (2) liquids from the pump outlet or other liquids are commingled with the inlet stream to reduce the inlet gas fraction, or (3) combinations of 1 and 2 are used to reduce the inlet gas fraction. Method 1 extends the operational range of the pump marginally, and methods 2 and 3 extend the operating range a little more but are extremely inefficient. Even with these approaches, pump seizing may still occur.

Therefore, there is a need for an efficient means of cooling the pump rotors to prevent the excessive heat buildup that occurs when the pump encounters fluids having high gas fractions.

SUMMARY OF THE INVENTION

The present invention includes a pump having a housing with an inlet, an outlet and an internal rotor enclosure; more than one rotor disposed in the enclosure, each rotor having a shaft and outwardly extending threads affixed to the shaft; a means for rotating the rotors, wherein a fluid stream entering the inlet is subjected to a pumping action that transports the fluids to exit the rotor enclosure through the outlet; a means for cooling the rotors while the rotors are rotating; a means for improving the sealing of the rotor chambers; and a means for improving the power efficiency of the pump.

The present invention includes apparatuses for cooling, sealing, and improving the power efficiency of high-pressure boost pump rotors used to pump high gas-fraction fluids. The described apparatuses include (1) the injection or pooling of cooled liquids at the high pressure end of the pump close to the pump outlet, and (2) the injection of fluids into sealed rotor chambers. The present invention may be used in conjunction with a variety of pump and rotor configurations. The present invention may be used with pumps having at least two rotors and the rotors may have any number and configuration of threads. For example, the present invention may be used advantageously with a single or a multistage rotor configuration.

Further, the present invention includes apparatuses for improving the pump efficiency when using (2) above, the injection of fluids into sealed rotor chambers. In this case, the fluid stream entering the pump is compressed more efficiently, and the saved energy is used to help turn the rotors, resulting in a lower power requirement for the pump.

One embodiment of the present invention is a pump that will inject fluids onto exposed rotors and into exposed rotor chamber areas. The exposed rotors and adjacent areas are located at the high pressure end of the pump proximal to the pump outlet. Another embodiment of the present invention will provide for the pooling of a liquid at the high pressure end of the rotor enclosure to cool the rotors. Furthermore, twin-screw pumps are described herein that take advantage of both the pooling and injection of cooled liquids onto high temperature areas of the pump rotors.

Another embodiment of the present invention comprises a pump having a heat transfer device in the rotor enclosure that is connected to a source of fluid that is circulated through the heat transfer device. This heat transfer device may be used to absorb heat from within the rotor enclosure and/or to help cool pooled liquids in the rotor enclosure.

Another embodiment of the present invention will provide fluids to the sealed rotor chambers to cool the rotors. In addition to cooling the rotors, these fluids may improve sealing of rotor chambers. This particular embodiment may be accomplished without any moving parts, resulting in improved reliability.

An additional embodiment is similar to the previous embodiment in that fluids are provided to sealed rotor chambers to cool the rotors and improve sealing. In this embodiment, however, the fluids are added to the sealed rotor chambers in a manner that improves the compression efficiency of the pump. The recovered energy may power other devices or may be used to reduce the power requirements of the pump and thus improve its overall power efficiency.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily used as a basis for modifying or designing other structures for carrying out the present invention. It should also be realized by those skilled in the art that such equivalent constructions do not depart from the spirit and scope of the invention as set forth in the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

It is to be noted that the drawings illustrate only typical embodiments of the invention and are therefore not to be considered limiting of its scope, for the invention will admit to other equally effective embodiments.

DETAILED DESCRIPTION OF THE INVENTION

The present invention is directed to a twin-screw pump for pumping multiphase fluids in oil field production. More particularly, the present invention relates to a twin-screw pump having means for cooling, improving the sealing of, and increasing the power efficiency of the pump when it is used to provide large pressure boosts to high gas-fraction wellhead inlet streams.

Figure 1:
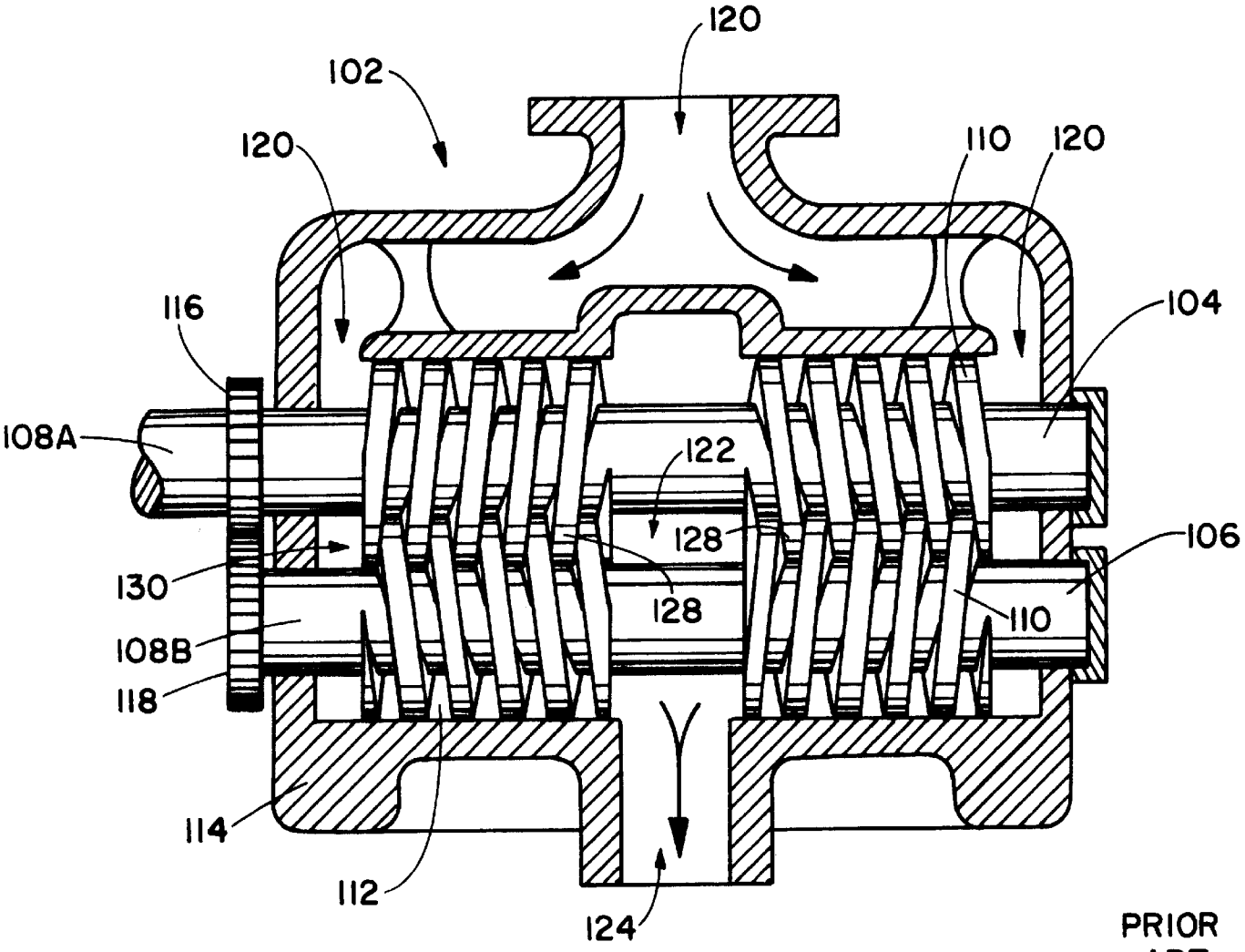
PRIOR ART FIG. 1
FIG. 1 is a cross-sectional view of a prior art twin-screw pump.

FIG. 1 shows a cross-sectional view of a typical twin-screw pump 102 that is commercially available. The twin-screw pump 102 has two rotors 104 and 106 that are embodied within a close-fit casing or pump housing 114. Each rotor has a shaft 108A and 108B with one or more outwardly extending screw threads 110 coiled around the shaft for at least a portion of the length of the shaft. The shafts 108A and 108B run axially within two overlapping cylindrical enclosures, collectively, a rotor enclosure 130. The two rotors do not touch each other, but the two rotors have threads of opposed screws (for example, on the right half of the rotors, shaft 108A may have left-hand threads and shaft 108B right-hand threads) that are intertwined such that chambers 112 are formed within the rotor enclosure 130.

Pump 102 will often be driven by a motor (not shown) which rotates rotors 104 and 106. A drive gear 116 on shaft 108A engages a second gear 118 on shaft 108B, such that when rotor 104 is turned by the pump motor, rotor 106 is turned at the same rate but in an opposite direction.

Wellhead fluids, including particulate material, are drawn into pump 102 at inlets 120. Most twin-screw pumps have inlets on the outer ends of the rotors and an outlet in the center of the pump. Thus, as the rotors are turned, the threads 110, or more properly, the rotor chambers 112, of the rotors displace the wellhead fluids along the rotor shafts 108A and 108B towards the center of the rotors, where the wellhead fluids are discharged. At the center of the rotors there is an outlet chamber 122, an area in the middle of the pump where the rotor shafts are exposed and are not threaded. When the fluids reach the center of the rotors, the point of greatest pressure, the fluids are discharged from the pump 102 through outlet 124.

In order to fully appreciate the advantages of the present invention, it is necessary to understand how twin-screw pumps work when pumping a multiphase fluid stream and when pumping incompressible fluids. The rotor threads of a twin-screw pump interact with each other and the rotor enclosure to form a number of rotor chambers 112. As the rotors turn, the chambers move from the inlet end of the pump to the outlet end of the pump. The chambers are not completely sealed, but under normal operating conditions the normal clearance spaces (or seals) that exist between the rotors and between each rotor and the rotor enclosure 130 are filled with liquid. The liquid in these clearance spaces, or seals, serves to limit the leakage of the pumped fluids between adjacent chambers. The quantity of fluid that does escape from the outlet side of the rotor back toward the inlet through these seals represents the slip of the pump.

When pumping incompressible fluids, such as liquids, the pressure difference between adjacent chambers is nearly the same for all adjacent pairs of chambers. The total pressure boost is the sum of all these pressure differences (where the inlet and outlet chambers are considered the first and last chambers). The pressure difference between adjacent chambers forces some fluid through the seals (i.e., slippage). However, since the pressure difference between adjacent chambers is about the same across the length of the rotor, then the slippage rate between each pair of adjacent chambers is about the same. Consequently, the work and heat generation of the rotor is fairly uniformly distributed along the length of the rotors when pumping incompressible fluids. Furthermore, the outlet volumetric delivery is nearly constant with time.

In contrast, when pumping highly compressible fluids, such as high gas-fraction multiphase streams, the pressure difference between adjacent chambers changes significantly from the ends to the middle of the rotors. The largest pressure difference is between the outlet chamber 122 and the sealed rotor chambers 128 nearest the outlet chamber. Consequently, the fluids slippage rate across the seal between chambers is greatest between the outlet chamber 122 and the last sealed rotor chambers 128 nearest the outlet chamber. Since the fluids in the last rotor chamber 128 are highly compressible, the fluids that flow across the seal between the outlet chamber 122 and the last rotor chamber 128 do not result in a large pressure increase in the last rotor chamber 128.

The next largest pressure difference, and fluids slippage rate, is between the rotor chamber nearest the outlet and the adjacent rotor chamber. The closer an adjacent chamber pair is to the inlet, the smaller the pressure difference, and fluids slippage rate, between chambers. As a consequence of this, twin-screw pumps at a given speed of revolution have a more constant inlet volumetric rate for multiphase flow than for incompressible fluid flow as a function of pressure boost of the pump.

When the fluid steam is highly compressible and the greatest pressure difference is between the last rotor chamber 128 and the outlet chamber 122, the volumetric output of the pump is not constant. The volumetric rate delivered to the outlet chamber 122 becomes negative as the last rotor chamber 128 opens to the outlet chamber 122 (the fluids from the outlet chamber 122 flow into the opened chamber). As the rotor turns, the outlet volumetric rate becomes positive, since all, or at least most, of the fluids in the last rotor chamber 128 at the time it is opened to the outlet chamber 122 (aside from fluids that slip though the seals into the adjacent lower-pressure rotor chamber) will ultimately be delivered to the outlet chamber 122 before the next rotor chamber opens to the outlet chamber.

Consequently, when pumping highly compressible fluids with a twin-screw pump, a very large part of the compression occurs as the last rotor chamber 128 opens to the outlet chamber 122, and a substantial part of the overall work is done by the section of the rotor thread forming the seal between the outlet chamber and the last rotor chamber. This disproportionate amount of work by that rotor element generates large quantities of heat in that rotor section. Thus, the rotor sections adjacent to the outlet chamber 122 generate the greatest quantity of heat along the length of the rotor. As the gas fraction increases, the compressibility of the fluid stream increases, and a greater part of the total heat generated by the rotors is concentrated in outlet chamber 122 and the rotor sections adjacent to outlet chamber 122. This is where and when pump seizing is most likely to occur. An embodiment of the present invention takes advantage of this situation by cooling the rotor shaft, threads, and rotor chambers in, and adjacent to, outlet chamber 122.

Figure 2:
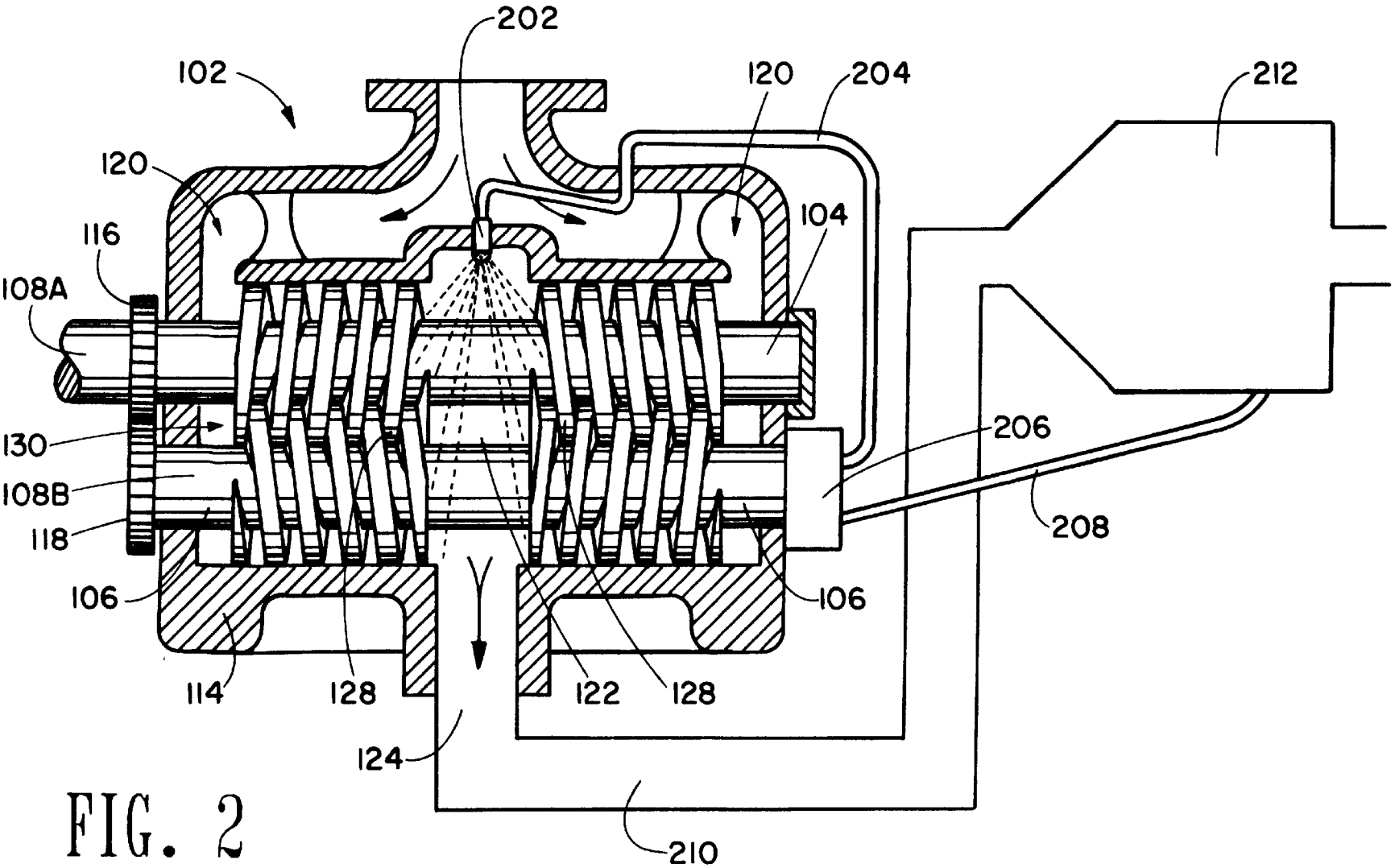
FIG. 2 shows one embodiment of a rotor cooling device used in conjunction with a twin-screw pump whereby liquids are injected into the outlet chamber.

FIG. 2 shows one embodiment of the present invention. Although the view and the discussions below are of a pump with inlets at the ends of the rotors and an outlet at the middle of the rotors, this invention applies equally to pumps with outlets at the ends of the rotors and an inlet at the middle of the rotors. As in a traditional twin-screw pump, the pump 102 of the present invention has rotors 104 and 106 that run axially within a rotor enclosure 130 of the pump housing 114, which may be a solid or split casing design with or without sleeves. While a horizontal axis of rotation for the rotors is shown, the present invention is equally effective for pumps having a vertical or other axis of rotation.

A pump drive (not shown) is connected to the power shaft 108A which rotates rotor 104. A drive gear 116 engages a second gear 118, such that when rotor 104 is turned by the drive, rotor 106 is also turned at the same rate but in an opposite direction. Of course, instead of being geared, the rotors may be direct-connected, belted, or chain-driven by the drive. The drive may be any form of prime mover and source of power practical for the circumstances, such as electric motors, gasoline or diesel engines, or steam and water turbines. Furthermore, mechanical seals may be used to provide a fluid-tight seal between the rotating shafts 108A and 108B and the stationary pump housing 114. Wellhead fluids are drawn into pump 102 at inlets 120 and are displaced along the axis of the shafts 108A and 108B towards the center of the rotors, where the wellhead fluids are discharged through outlet 124. A pipeline is attached to the outlet 124 for transporting the fluids to a remote processing site.

As illustrated in the drawing, injectors 202 are implanted in the pump casing or housing 114 so that injectors 202 can spray fluid in the outlet chamber 122 to cool the rotors 104 and 106. In operation, pumped fluids exit the pump 102 at the outlet 124 and are carried within pipe 210 to a gas/liquid separator 212. Liquids from the separator 212 are carried within line 208 and are fed into an auxiliary injection pump and cooler 206. The cooled liquids are then pumped through injection line 204 to the injectors 202 which spray the cooled liquid on the rotors. While any part of the outlet stream may be used to cool the rotors, it is generally preferable to use primarily liquids, as for a given volume of fluids, they are the most effective in carrying away heat. A driving force is required to flow the fluids through the cooler and the injectors. This force may be provided by a separator elevated sufficiently above the pump or by an auxiliary pump. The cooler 206 is optional. Generally, the lower the temperature of the sprayed fluids, the smaller the volume of injected fluids that is required to remove a given amount of heat.

FIG. 2 demonstrates this embodiment of the invention in connection with a particular type of pump and rotor configuration. Other types of pumps and rotor configurations, as for example a multistage twin-screw pump as described in more detail in co-pending patent application Ser. No. 08/671,696, entitled "A Power Efficient Multistage Twin-Screw Pump," which is incorporated herein by reference, can also benefit from the present invention. Moreover, if the pump is constructed such that the outlet chambers 122 are at the ends of the rotors instead of the middle, then the cooled fluids will be provided at the ends of the rotors. This embodiment is meant to provide cooled fluids at the rotor sections experiencing the highest pressure and temperature.

For ease of discussion, only one half of the rotor is discussed. As depicted in FIG. 2, an even number shaft, ads having identical profiles are mounted on one shaft, one half facing one direction and the other half facing in the opposite. In this arrangement, the axial thrust of one half is balanced by the other. Nevertheless, since a pump is primarily a product of a foundry or machine shop and can wear with time and minor irregularities result that may cause differences in eddy currents around the rotor stages, the pump must be designed to take some thrust in either direction. The rotors, as well as the other parts of the pump, may be manufactured of almost all known common metals or metal alloys, such as cast iron, bronze, stainless steel, as well as of carbon, porcelain, glass, stoneware, hard rubber, and even synthetics. If desired, two or more pumps of similar design may be used in series or parallel connected by external piping to meet extreme pumping demands.

Pump 102, as illustrated in FIG. 2, may have a variety of injector configurations. A preferred embodiment of the present invention would place the injectors 202 in a configuration and at calculated angles, such that the dispensed fluid would hit the rotor shafts exposed in the outlet chamber 122 and will also optimally bathe the rotor threads that are adjacent to the outlet chamber 122 and insert liquid into the last rotor chambers 128 as the rotors turn. The injectors 202 may be implanted in the side of the pump 102 opposite the outlet 124 as seen in FIG. 2, the injectors may be implanted in the two sides of pump 102 opposite and next to the pump outlet 124 as illustrated in FIG. 4, or the injectors may be located in other locations allowing adequate spraying of the rotors and into the rotor chambers.

Figure 3A:
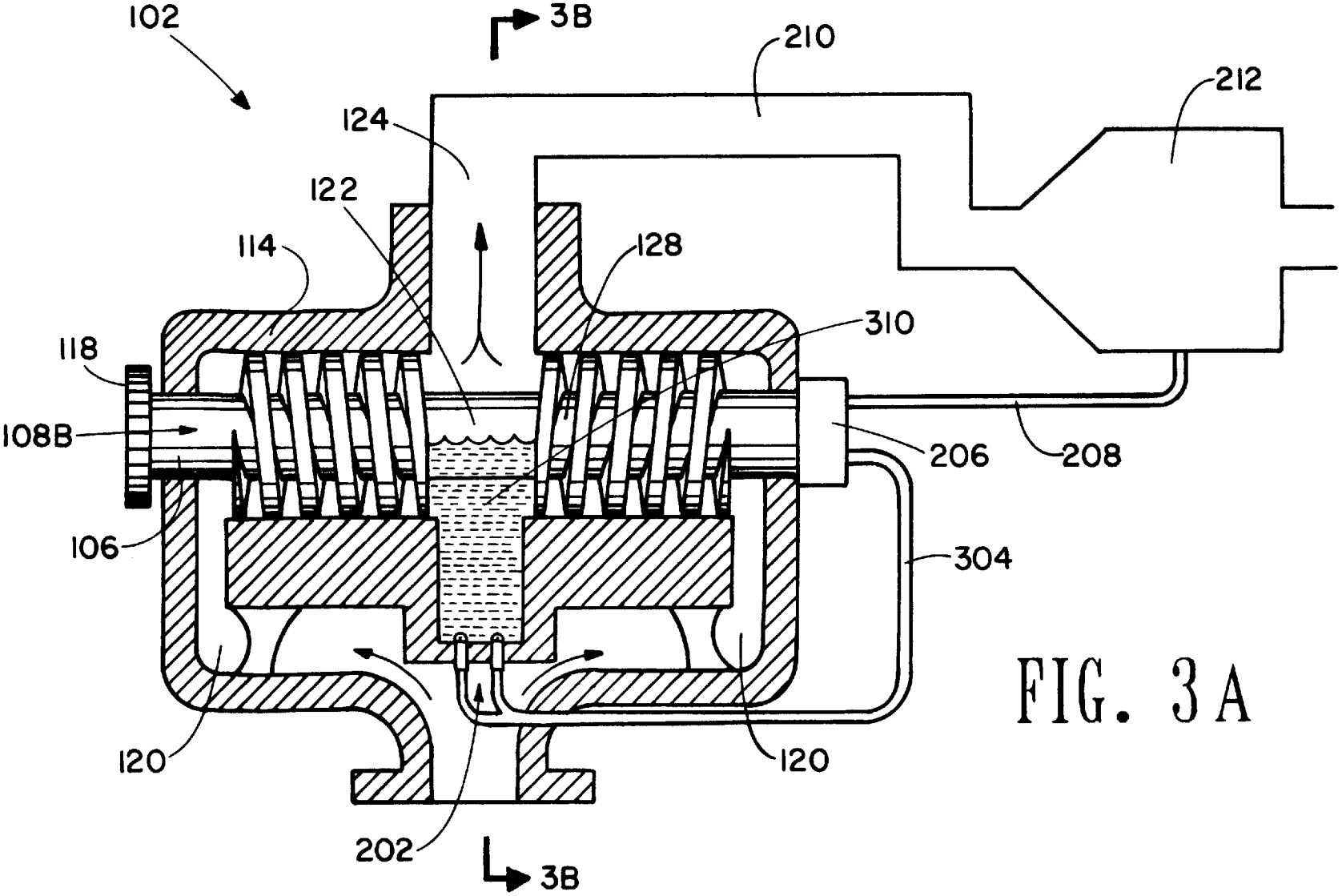
FIG. 3A shows an alternative embodiment of a rotor cooling device used in conjunction with a twin-screw pump whereby liquids are pooled in the outlet chamber.
Figure 3B:
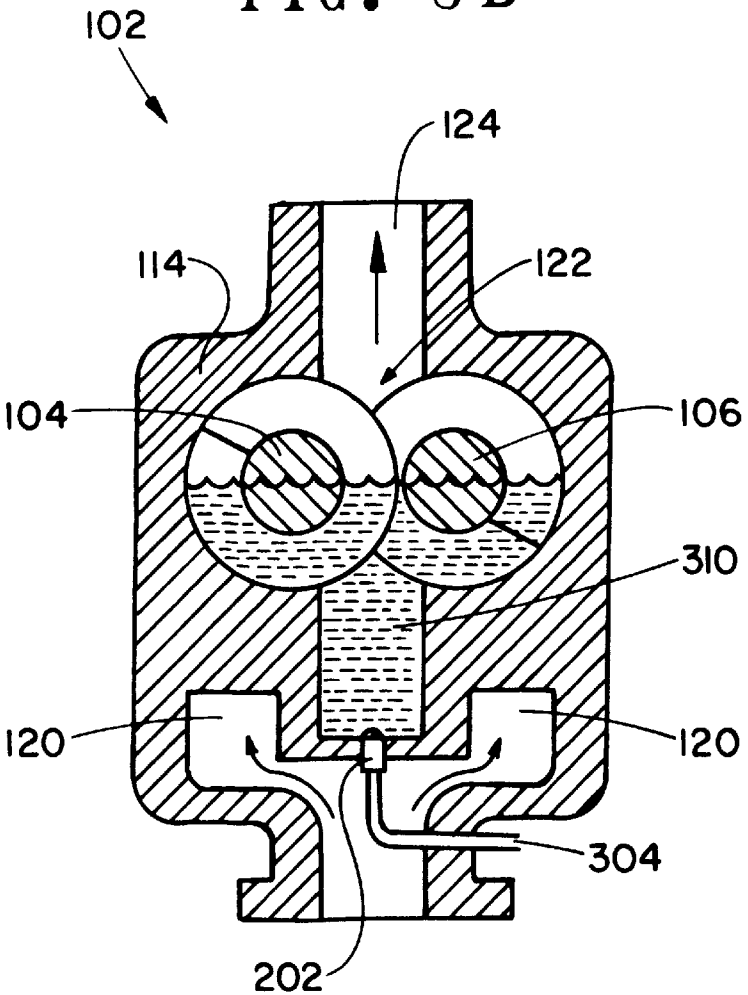
FIG. 3B shows a partial cross-section of the embodiment of the rotor cooling device of FIG. 3A taken along Section 3B—3B.

FIGS. 3A and 3B illustrate an alternative embodiment of the present invention with feed lines 304 implanted in the side of pump housing 114 across from outlet 124. These two figures show the rotors in a horizontal arrangement. Feed lines 304 supply cooled liquids into a liquid pool 310 on the opposite side of the outlet chamber 122 from outlet 124. The pool of cooled liquid flows onto accessible rotor parts and into the last rotor chambers 128 adjacent to the outlet chamber 122 when last rotor chambers 128 first open. If the pump outlet 124 is not at the top of outlet chamber 122, then a system of baffles or weirs must be employed to retain a sufficient supply of cooled liquid in the outlet chamber 122 to dissipate the high temperatures generated by the pump. As in FIG. 2, liquids from the separator 212 are carried to an auxiliary pump 206 by line 208. The cooled liquids are then pumped through feed lines 304 to the injectors 202. FIG. 3B shows how both rotors 104 and 106 and their threads are bathed by the liquid pool 310.

Figure 4:
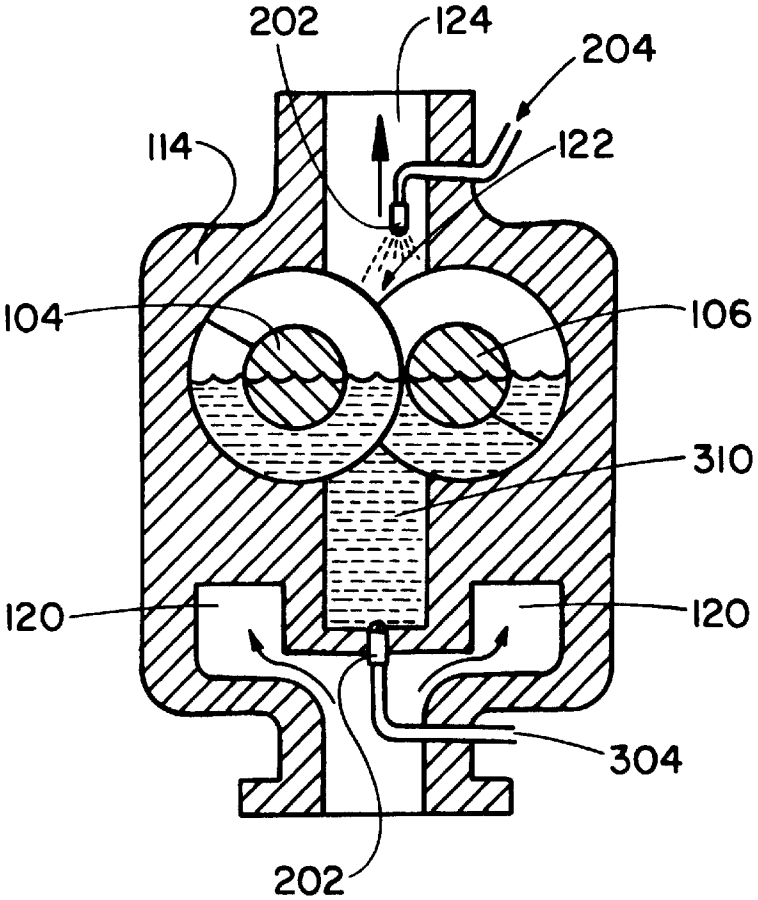
FIG. 4 shows a partial cross-section of an alternative embodiment of a rotor cooling device whereby liquids are injected and pooled in the outlet chamber.

Another embodiment of the present invention, illustrated in FIG. 4, has injectors 202 implanted in two sides of pump housing 114. Feed lines 304 supply cooled liquids into a liquid pool 310 on the opposite side from outlet 124. Feed lines 204 supply cooled liquids for spraying the rotors. This configuration would allow the injectors to spray the accessible areas with a cooled liquid in conjunction with the liquid pool bathing the high pressure area of the rotors.

Figure 5:
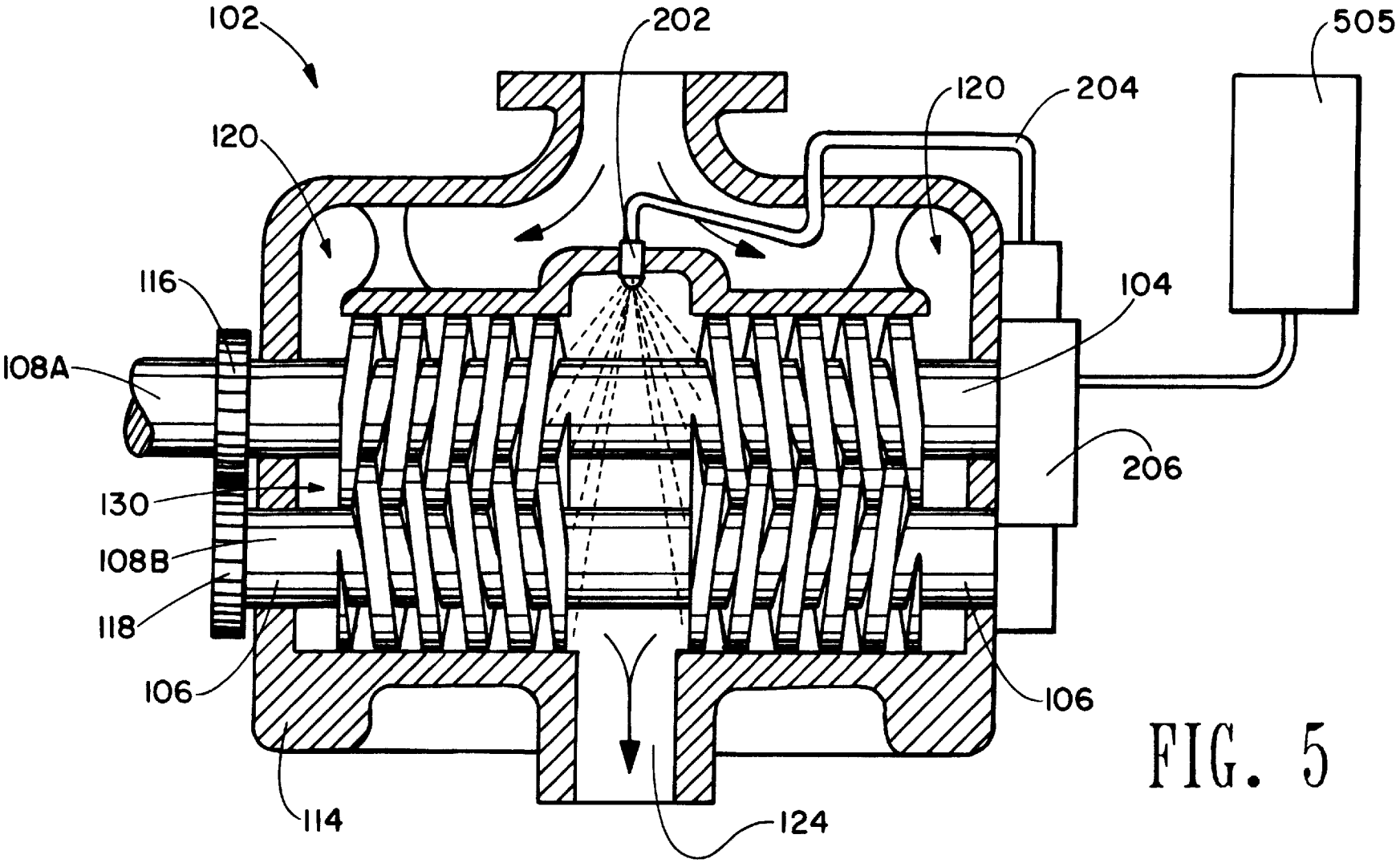
FIG. 5 shows a diagrammatic view of one embodiment of a source of liquid for use with the rotor cooling device.

The cooled liquids to be injected may be provided from a variety of sources. For example, referring to FIG. 2, liquids from the pump outlet may be drawn from the liquid leg 208 of a gas/liquid separator 212 located downstream of pump 102. Other sources of liquid may also be employed, as for example liquids from reservoir 505 shown in FIG. 5. Liquids contained in reservoir 505 may be used to supplement the liquid drawn from gas/liquid separator 212 or they may be used as the sole supply of injected liquids. The use of reservoir liquids would also allow the operator full control of the physical and chemical characteristics of the injected fluid. For example, reservoir 505 may be supplied with selected chemical mixtures that can help to prevent or remove scale or paraffin deposits in the pump and downstream hardware. The fluids to be injected may be drawn from a liquid supply that contains prechilled liquids, or the liquids may be pumped or drawn through a cooler, similar to cooler 620 described below.

Figure 6A:
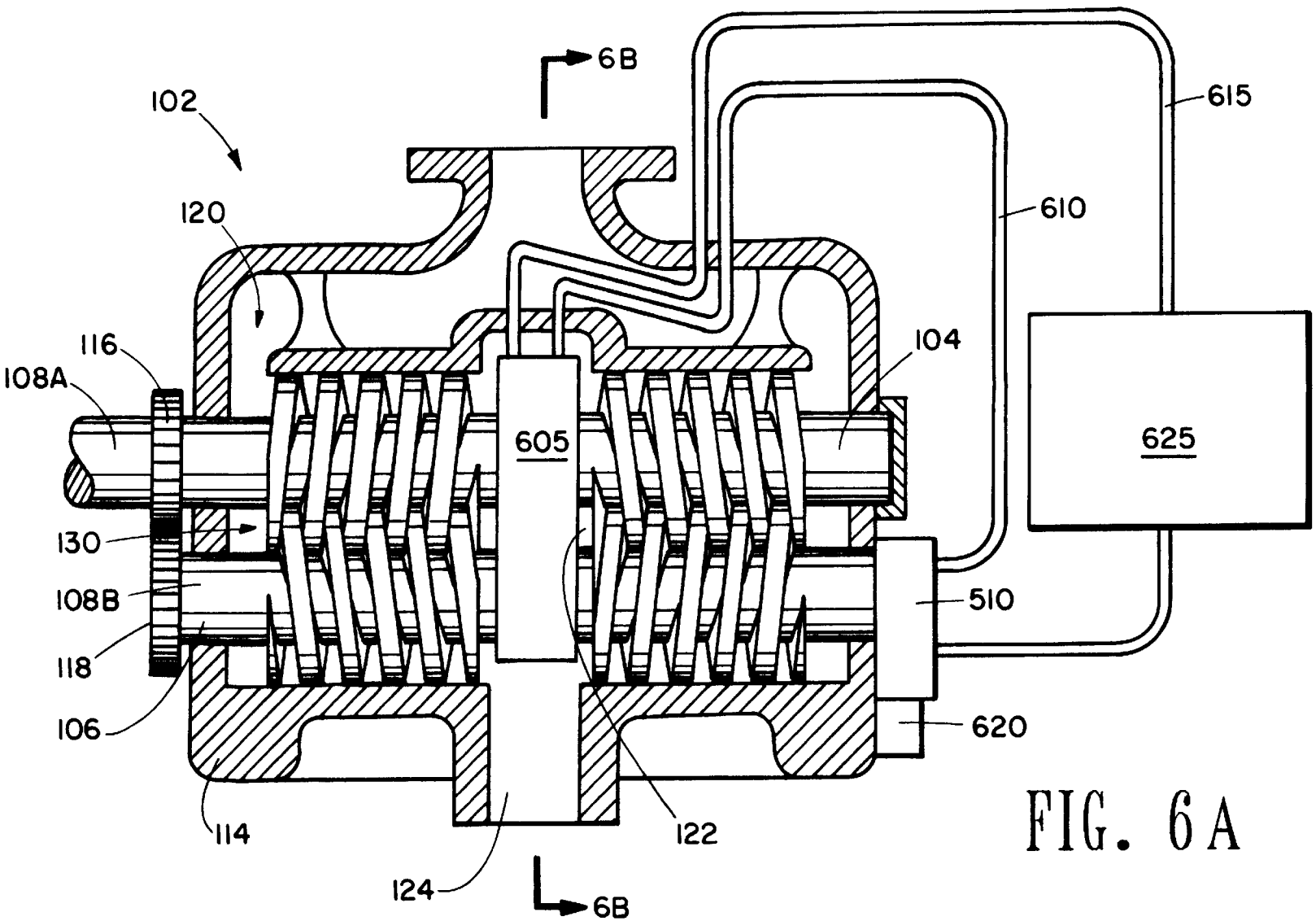
FIG. 6A shows an alternative embodiment of a rotor cooling device whereby a heat transfer means is situated in the outlet chamber.
Figure 6B:
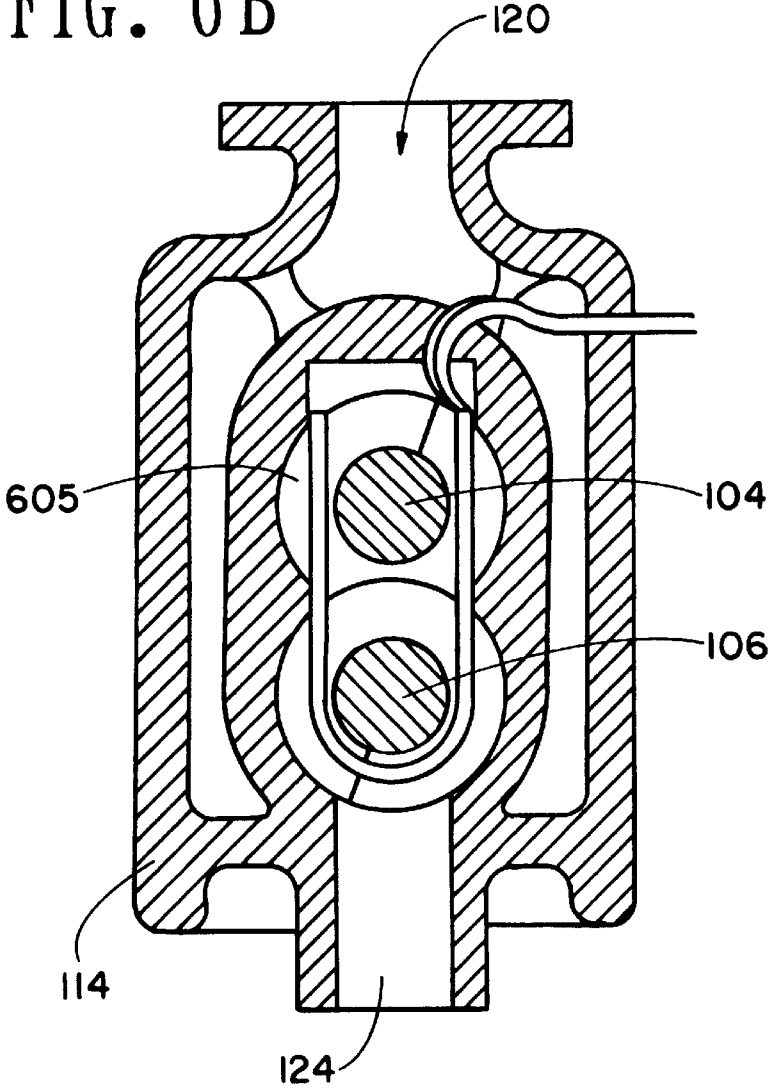
FIG. 6B shows a partial cross-section of the embodiment of the rotor cooling device of FIG. 6A taken along Section 6B—6B

Yet another embodiment of the present invention is shown in FIGS. 6A and 6B. In this embodiment, a heat transfer means is situated in outlet chamber 122. A preferred embodiment of the heat transfer means is a sealed cooling device 605 composed of a thermally conductive material and containing a circulating liquid coolant. The coolant is supplied to cooling device 605 through supply line 610 and returned to a cooler 620 by return line 615. Cooler 620 may be any one of a variety of types of coolers, for example it may be an electrical cooler or it may represent a length of thermally conductive pipe situated in a cool environment (such as the ocean). Cooler 620 may be connected to a coolant reservoir 625 with a supply of the liquid coolant as shown in FIG. 6A.

Sealed cooling device 605 may be used to absorb heat from outlet chamber 122. Sealed cooling device 605 may also be used to cool the liquid pooled in the outlet chamber 122 as described above. In this embodiment, the sealed cooling device will be located such that it is in contact with the pooled liquids. FIG. 6B shows one possible embodiment of the cooling device 605 and its relationship to the rotors 104 and 106. The cooled liquids are dispensed, or circulated through cooling device 605, utilizing a dispensing pump 510. Dispensing pump 510 may be driven by the rotation of the shaft 106 or by an auxiliary pump. The dispensing pump 510 may run constantly or it may be thermostatically controlled, such that it is engaged only when the rotor temperature reaches a certain level.

Figure 7:
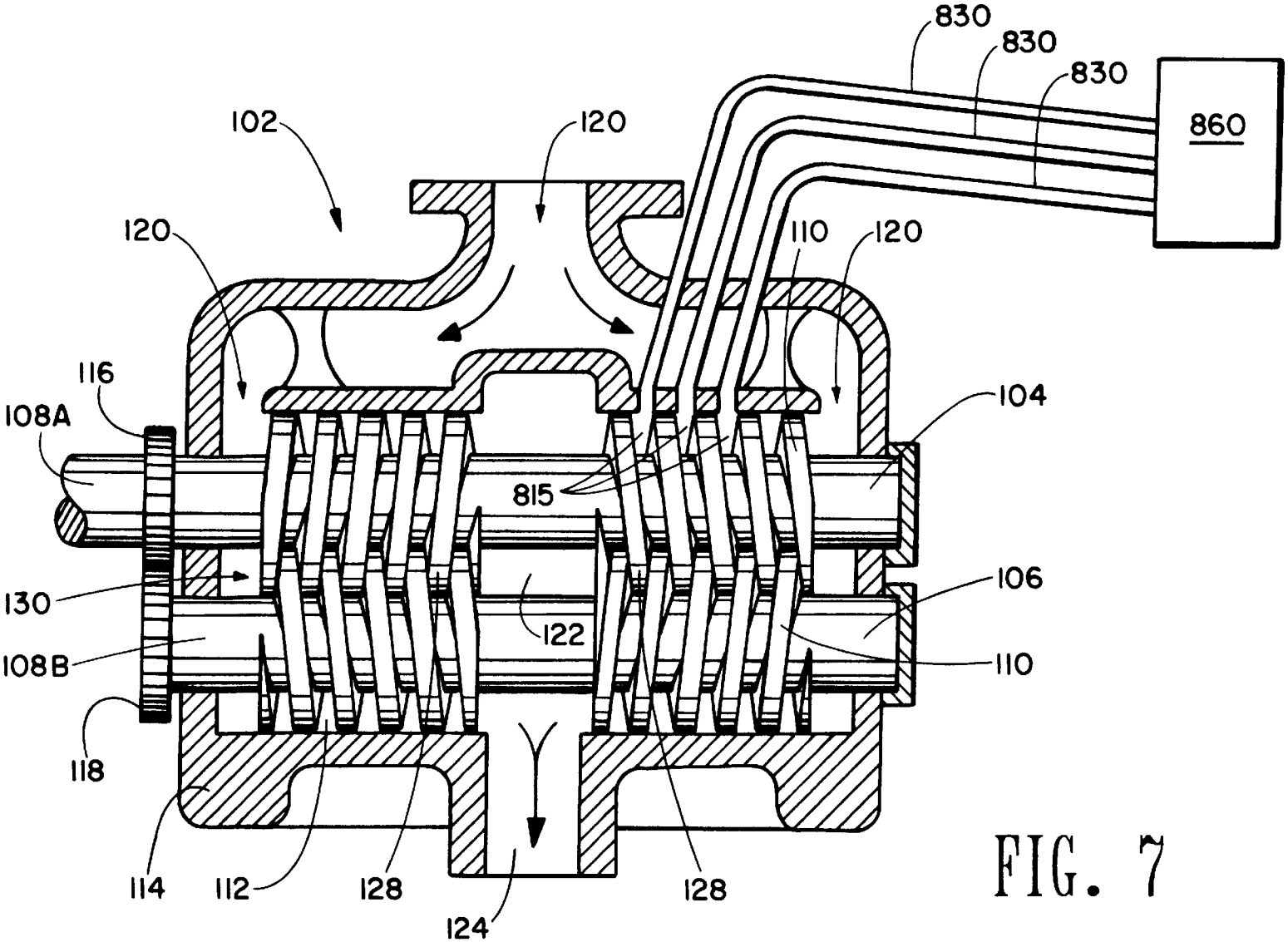
FIG. 7 shows an embodiment of the present invention wherein fluids are added to the sealed rotor chambers of the pump.

As seen in FIG. 7, another embodiment of the present invention is a system that injects fluids in, or allows fluids to be added to, one or more of the sealed rotor chambers in a controlled manner. Only the part of the system associated with the upper rotor right half is shown. Each half of each rotor has such a system for each stage of the pump. These fluids are drawn from a fluids source reservoir at a pressure near the pump or pump stage outlet pressure or higher and are hence referred to as source fluids. As in the previous embodiments, these source fluids may be liquids separated from the pump or pump stage outlet stream and/or reservoir liquid. These fluids may be cooled if desired. For example, reservoir 860 provides source fluids to fluid lines 830 which are in fluid communication with the sealed rotor chambers 815. There is a separate fluid line for each rotor chamber opening. As depicted, only three rotor chambers have fluid lines 830—not every sealed rotor chamber is required to be connected to the reservoir. As desired for the application, fluids may be added to each rotor chamber connected to the reservoir 860 individually or at the same time as other rotor chambers are receiving fluids. Further, the fluids added to the sealed rotor chambers as described in this embodiment need not be pumped as they are flowing from a source at near or above pump outlet pressure to pump rotor chambers which are at pressures between the inlet and outlet pressures. Although only a single stage pump is depicted, this controlled method of adding fluids to the rotor chambers is equally effective for multistage pumps.

This embodiment allows cooling and sealing of the inner sealed rotor chambers as well as the last rotor chamber of a rotor stage. In the case where the angle between each shaft and the horizontal is non-zero, this embodiment is especially beneficial.

This embodiment does not significantly change the pump power and volumetric efficiencies unless significant additional fluids propagate back through the seals to the inlet. Fluid propagation back through the seals to the inlet is determined by a number of factors including the pump seal gaps, properties of the fluids being pumped, rate of source fluids additions, and the pressure difference between the inlet and the first rotor chamber. The propagation of fluids back through the seals to the inlet is greatest if all the source fluids are added to the sealed rotor chamber closest to the inlet; this results in the largest first rotor chamber pressure. The propagation of fluids back through the seals to the inlet is least if all the source fluids are added to the sealed rotor chamber closest to the outlet. This results in the smallest first rotor chamber pressure and the least fluids leakage from the first chamber to the inlet.

It is preferable that the fluids added to the sealed rotor chambers be added in a controlled manner so as to distribute the work done by the pump more evenly along the length of each rotor. For example, for high gas-fraction production streams, a volume of liquid from the source equal to about 15% or more of the volume of a rotor chamber may be added to each rotor chamber. This will increase the pressure in the rotor chamber, decrease the amount of compression which occurs as the rotor chamber opens to the outlet, and provide additional mass to carry away the generated heat and improve sealing. Larger amounts of heat may be handled if cooler source liquids are used or if larger amounts of source liquids are used. Uncontrolled source fluids additions, however, are to be avoided. They do help, but are not as effective as controlled additions in distributing the heat generation along the rotors.

This embodiment thus allows for adding of fluids from a source at near outlet pressure to the sealed chambers of the pump for cooling and sealing without any moving parts. Of course, when the pump inlet stream is all liquid—and consequently cooling and sealing help are not needed--very little fluid will be added to the rotor chambers via this embodiment.

Figure 8:
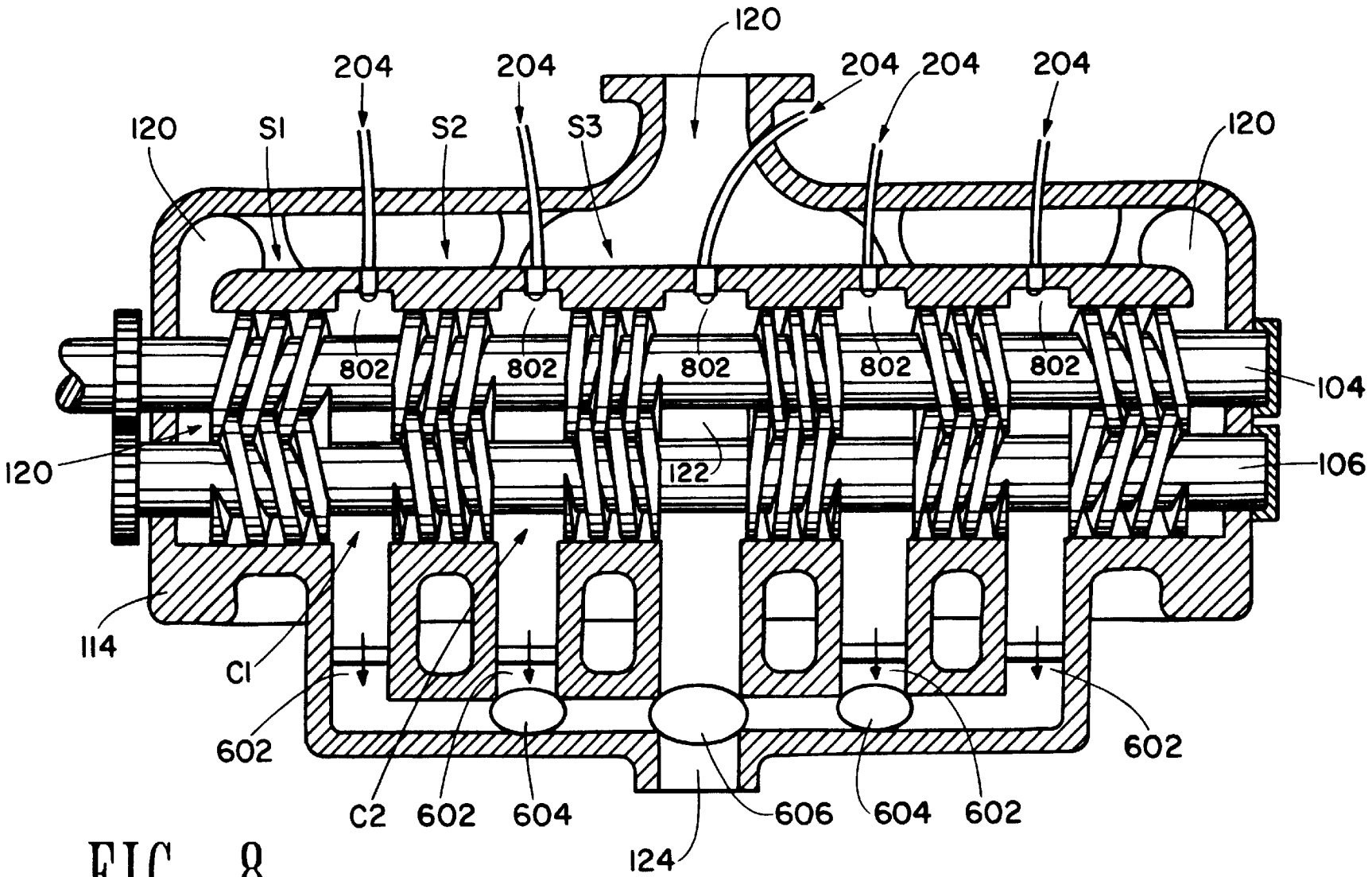
FIG. 8 shows one embodiment of the present invention used in conjunction with a twin-screw pump having multistage rotors.

Referring now to FIG. 8, an embodiment of the present invention is shown in conjunction with a multistage twin-screw pump. A multistage twin-screw pump and its advantages is described in detail in co-pending patent application Ser. No. 08/671,696, entitled "A Power Efficient Multistage Twin-Screw Pump," which is incorporated herein by reference. Each stage of the multistage twin-screw pump may have injectors, liquid feed lines, and/or cooling devices with liquid pools situated to cool that stage with liquid separated from the outlet stream of that stage or subsequent stages or from a reservoir. As with the single stage pump described above, a variety of configurations of injectors, liquid pools and cooling devices may be designed to optimally cool a multistage twin-screw pump.

As in a traditional twin-screw pump, the multistage pump 102 has rotors 104 and 106 that drive the fluids within the rotor enclosure 130 from the inlets 120 to the outlet 124. In this embodiment, however, the threads on the rotor shafts 108A and 108B between the inlet and outlet are not continuous, but rather are separated into three sections or stages S1, S2, and S3 by two non-pumping chambers C1 and C2 which do not have any threads. The advantage of having separate sections or stages is that the rotor and enclosure design in each section may be different. This allows the inlet volumetric rate of each stage to be different, which allows the pump to be more efficient when pumping multiphase streams. Here, injection lines 204 feeds cooled liquids to a plurality of injectors 202 which spray the cooled liquids onto the rotors, threads, and rotor chambers at each of the non-pumping chambers C1 and C2.

A major advantage in injecting, or pooling cooled liquids in pump 102, rather than commingling liquids from the pump outlet with the inlet stream, is the increased power efficiency and volumetric capacity of the pump as compared to current recycle systems. In currently available twin-screw pumps with recycle systems, the liquids emerging from the pump are recycled or added to the inlet stream to reduce the inlet stream gas fraction. This design increases the pump workload and decreases the volumetric capacity of the pump/recycle system by requiring that all of the gas that evolves from the injected liquids be recompressed as well as requiring that the recycled liquids be repumped. As long as a cooled liquid supply is available, this invention will allow enough heat to be removed such that pump 102 may pump gas fractions up to and including 100%. In addition, the liquids supplied to help remove heat from the high pressure areas of the rotors, help maintain the seals between the two rotors and between each rotor and the rotor enclosure 130.

In another embodiment which enhances the previous embodiment to improve the power efficiency of the pressure boosting system, energy is recovered as the fluids from a source at near outlet pressure are added to the sealed chambers which are at pressures between the inlet and outlet pressures. This allows a more power efficient total system. Without this or the previous embodiment, a major part of the gas compression is accomplished in a very inefficient manner, that is, by the rushing of outlet fluids into the last rotor chamber as it opens to the outlet. This embodiment allows the gas compression to be accomplished with fluids at pressures closer to those of the gas being compressed in each rotor chamber--which is more efficient. The source fluids are driven into each rotor chamber by a driving pressure which is slightly greater than the rotor chamber pressure, rather than by the greater source pressure.

The pressure difference between the source reservoir pressure and the driving pressure, the "extra" pressure, may be used to generate "extra" energy. The "extra" energy generated or recovered in this way may be used to help drive the pump, resulting in an improved overall system power efficiency. This energy recovery may be done in many ways depending upon the application and resulting in different energy recovery factors and other operating factors.

Figure 9:
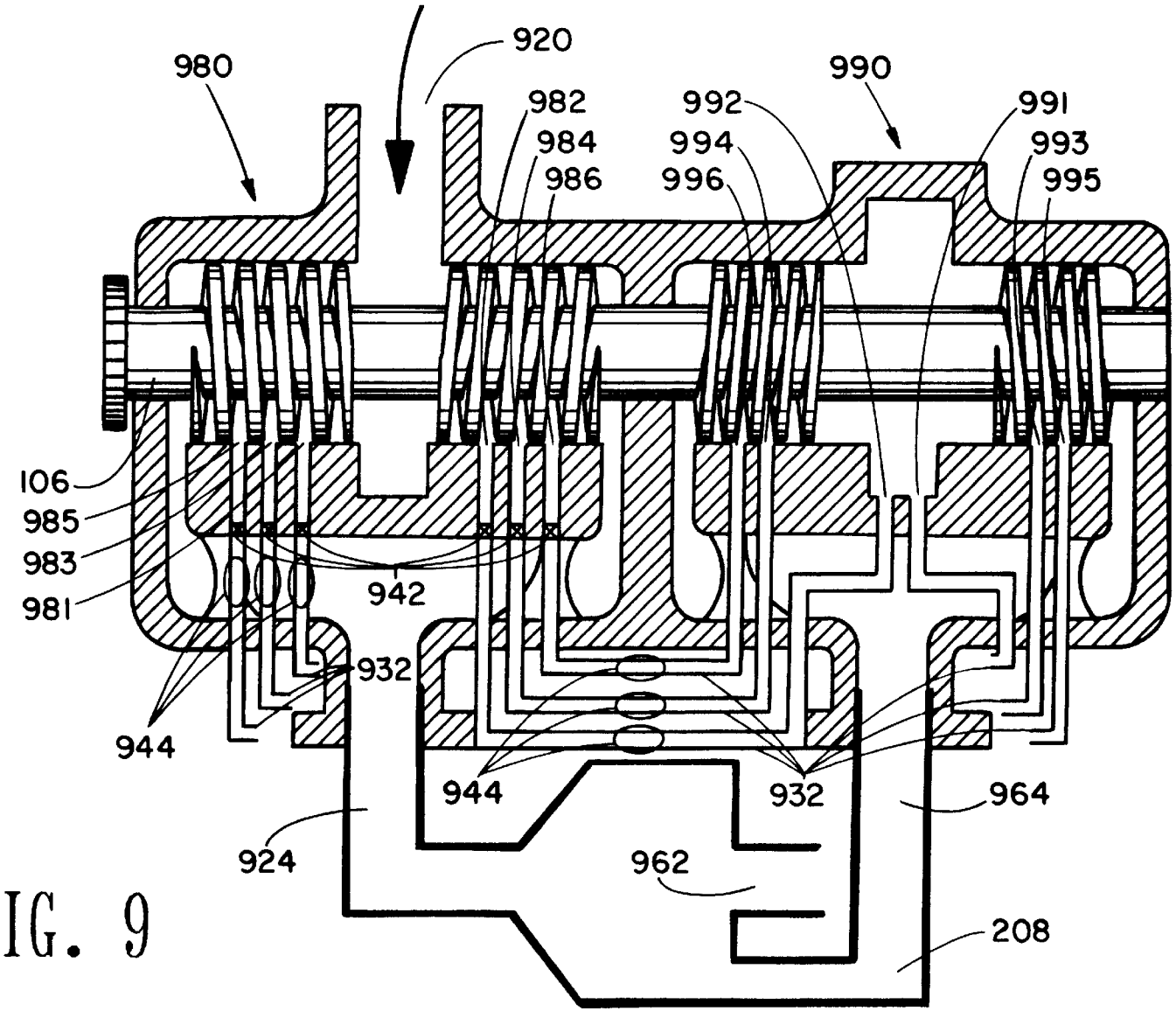
FIG. 9 shows another embodiment having a production stream pump and an energy recovery pump.

An illustration of a more power-efficient system as described above using a twin-screw pump to recover the "extra" energy and to improve the overall power efficiency is shown in FIG. 9. In this illustration, the production stream is pressure boosted by the left part of the rotors or production pump 980. The production stream enters the middle of the production pump rotors at inlet 920 and is pumped to the ends of the production pump rotors towards outlet 924. (This is backwards from normal twin-screw operation. Of course, the same results may be obtained by running a suitably designed system in the normal manner.) A source of liquids, at near to production pump outlet pressure, feed the ends of the right portion of the rotors or energy recovery pump 990. As such, feed lines 932 are connected between respective rotor chambers of the production pump to respective rotor chambers of the energy recovery pump. That is, on one side, chamber 981 to chamber 991, chamber 983 to chamber 993, chamber 985 to chamber 995, and on the other side, chamber 982 to chamber 992, chamber 984 to chamber 994, and chamber 986 to chamber 996. The ports into and out of the rotor chambers should be designed so as to minimize large pressure loses. Multiple round ports or an elongated port following the chamber shape can meet the pressure loss requirements. These ports should, of course, be at locations along the rotor such that they are never directly exposed to the inlet or outlet chambers of the pump. In essence the highest to lowest pressure chambers of the energy recovery pump 990 are connected to the highest to lowest pressure chambers of the production stream pump 980, respectively. The outlet of the energy recovery pump is in the middle of the rotors and is at a pressure close to the inlet pressure of the production stream pump which is significantly lower than the production stream pump outlet pressure.

The large pressure difference between the inlet (ends) and outlet (middle) of the energy recovery pump 990 results in a large torque which assists in turning the rotors of the production stream pump 980. Thus, a smaller motor is capable of driving the system than would be necessary were the energy recovery pump not present. This is only possible due to the large pressure difference across the energy recovery pump. This large pressure difference is possible only if all the fluids fed into the energy recovery pump are exhausted into the production stream pump. This is accomplished through a number of feed lines 932 with optional check valves 942 and pressure accumulation tanks 944. Ideally, the flow rate through the lowest pressure line is small so as to minimize production stream pump leakage back to the inlet chamber—which decreases efficiency.

The energy recovery pump 990 must be sized so as to intake less fluid than may be added to the production stream pump 980. As the energy recovered is proportional to the inlet volume of the energy recovery pump, the larger this pump is sized the more energy that can be recovered. Depending on the application, check valves and pressure accumulation tanks on the connecting lines may be desirable. These affect how the pump handles slugs of liquids in the production pump inlet stream. An optional pressure reservoir on the outlet 962 of the energy recovery pump 990 allows a relatively constant recovery pump outlet pressure to be maintained during brief periods when fluids are not flowing from the energy recovery pump to the production stream pump, as for example when a liquid slug is flowing through the production stream pump. The size of these pressure accumulation tanks is a function of the size of the production stream liquid slugs the system is to handle without significant increase of energy recovery pump outlet pressure. These tanks are installed so as to be normally gas filled. Filtering of inlet flow can reduce accumulation tank volume requirements.

As long as the pressure drop across the energy recovery pump is maintained, the energy recovery pump continues to assist in the rotation of the rotors—even when the production stream pump is pressure boosting a liquid slug. (However, as the energy recover pump outlet pressure rises, the power provided by it to turn the production pump rotors decreases.) The recovery of power in this way allows a smaller power source to be used for driving the complete system, less heat generation, and consequently a smaller heat removal problem. Other arrangements, such as locating the energy recovery pump above or below the production stream pump with separate rotors, or locating the energy recovery pump in a different location relative to the production pump along the rotors or using a different type of pump as the energy recovery pump(s), may be used.

Figure 10:
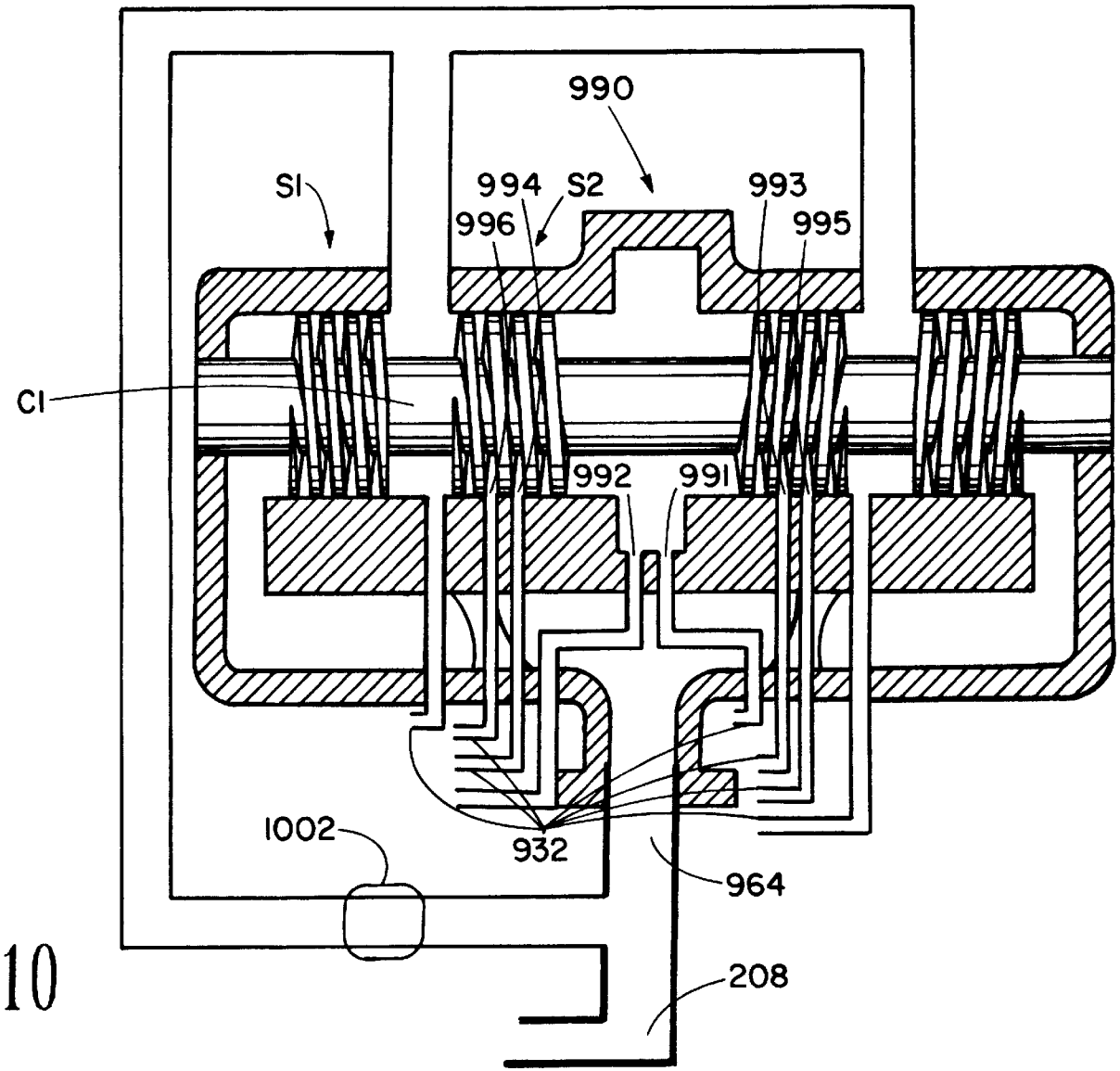
FIG. 10 shows an embodiment having a multistage energy recovery pump with valving to source fluids which allows different source liquid rates to flow into the energy recovery pump at a given pump speed.

If the inlet volumetric rate of the energy recovery pump is too great for a particular application, then a pressure drop may be taken between the fluids source for the energy recovery pump and the energy recovery pump inlet to reduce the inlet volumetric rate at production stream pump outlet pressure—with a resulting loss in efficiency. Alternatively, a multistage twin-screw pump may be used to vary the total inlet volumetric rate of the energy recovery pump, thereby allowing several distinct inlet volumetric rates as shown in FIG. 10. The inlet volumetric rate of each stage can vary and valves can control which stage inlets are at the source pressure.

FIG. 10 shows an energy recovery pump 990 with two possible inlet volumetric rates. With the valve 1002 connecting the inter-stage chamber C1 to the source fluids closed, the inlet volumetric rate of the energy recovery pump is determined by the inlet volumetric rate of the first stage S1 of the energy recovery pump which is connected to the source fluids. If the valve 1002 connecting the inter-stage chamber Cl to the source fluids is open, the inlet volumetric rate of the energy recovery pump is determined by the inlet volumetric rate of the second stage S2 of the energy recovery pump which may be designed to be smaller than the inlet volumetric rate of the first stage S1.

An alternative, but perhaps less efficient system, of this embodiment is to connect the outlet of the energy recovery pump to the inlet of the production stream pump. Yet another alternative which allows the deactivation of the energy recovery pump is to add a line with a valve from the energy recovery pump outlet to the production pump outlet.

Although the present invention and its advantages have been described in detail, it should be understood that various changes, substitutions and alterations can be made herein without departing from the spirit and scope of the invention as defined by the appended claims.

What is claimed is:

1. A pump, comprising:

a housing, having an internal rotor enclosure, said enclosure having an inlet, and an outlet;

a plurality of rotors operably contained in said enclosure, each rotor having a shaft and a plurality of outwardly extending threads affixed thereto, said threads and rotor enclosure forming a plurality of rotor chambers;

wherein a first portion of said rotors defines a production pump;

wherein a second portion of said rotors defines an energy recovery pump;

means for rotating the rotors, wherein a fluid stream entering from the inlet is subjected to a pumping action to transport said fluids to exit said internal rotor enclosure through the outlet; and a plurality of feed lines connected between respective rotor chambers of said production pump to respective rotor chambers of said energy recovery pump.

* * * * *